US005339493A

United States Patent [19]

MacIntyre

[11] Patent Number: 5,339,493

[45] Date of Patent: Aug. 23, 1994

[54] ADJUSTABLE HINGE

[76] Inventor: Robert J. MacIntyre, 1938 River Bend Ct., Mequon, Wis. 53092

[21] Appl. No.: 969,098

[22] Filed: Oct. 30, 1992

[51] Int. Cl.[5] ..... E05D 7/04

[52] U.S. Cl. ..... 16/238; 16/237

[58] Field of Search ..... 16/237, 238, 248

[56] References Cited

U.S. PATENT DOCUMENTS

| | | | |
|---|---|---|---|
| 730,265 | 6/1903 | Hill . | |
| 994,196 | 6/1911 | Reddick . | |
| 1,307,807 | 9/1912 | Thurber . | |
| 1,782,490 | 11/1930 | Torgerson . | |
| 2,255,529 | 9/1941 | May . | |
| 3,210,798 | 10/1965 | Tice . | |
| 3,596,307 | 8/1971 | Kolmetsky | 16/237 |
| 3,940,829 | 3/1976 | Grunert et al. | 16/DIG. 43 |
| 4,159,557 | 7/1979 | Pittasch et al. | 16/237 |
| 4,185,357 | 1/1980 | Busse | 16/DIG. 43 |
| 4,493,129 | 1/1985 | Grass | 16/238 |
| 4,785,498 | 11/1988 | Brotschi | 16/238 |
| 4,817,241 | 4/1989 | Koch et al. | 16/238 |
| 4,825,507 | 5/1989 | Killingstad | 16/241 |
| 5,058,236 | 10/1991 | Henson | 16/238 |

FOREIGN PATENT DOCUMENTS

| | | | |
|---|---|---|---|
| 189536 | 4/1957 | Austria | 16/237 |
| 1809829 | 9/1970 | Fed. Rep. of Germany | 16/235 |
| 2736393 | 2/1978 | Fed. Rep. of Germany | 16/238 |
| 2920843 | 12/1980 | Fed. Rep. of Germany | 16/237 |
| 3004313 | 8/1981 | Fed. Rep. of Germany | 16/238 |
| 2032994 | 5/1980 | United Kingdom | 16/237 |

*Primary Examiner*—Lowell A. Larson
*Assistant Examiner*—Donald M. Gurley
*Attorney, Agent, or Firm*—Andrus, Sceales, Starke & Sawall

[57] ABSTRACT

An adjustable hinge for interposition between a door and a frame includes a frame leaf, a door leaf pivotably mounted to the frame leaf, and an adjustable mounting assembly mounted to the door and with which the door leaf is engaged. The mounting assembly includes a cover fixed to the door and a base mounted to the cover, with the door leaf being engaged with the base. The base is fixed against horizontal movement relative to the cover, and a horizontal adjustment screw is engaged with the base. The door leaf is mounted to the adjustment screw for movement in a front-rear direction along with the adjustment screw to adjust the horizontal position of the door relative to the door leaf, and thereby relative to the frame. The base is mounted for vertical up and down movement to the cover, and an adjustment screw is provided for controlling the vertical position of the base relative to the frame. Substantially the entire extent of the adjustable mounting assembly is received within a recess formed in the door to conceal the adjustment mechanism.

29 Claims, 2 Drawing Sheets

FIG. 1
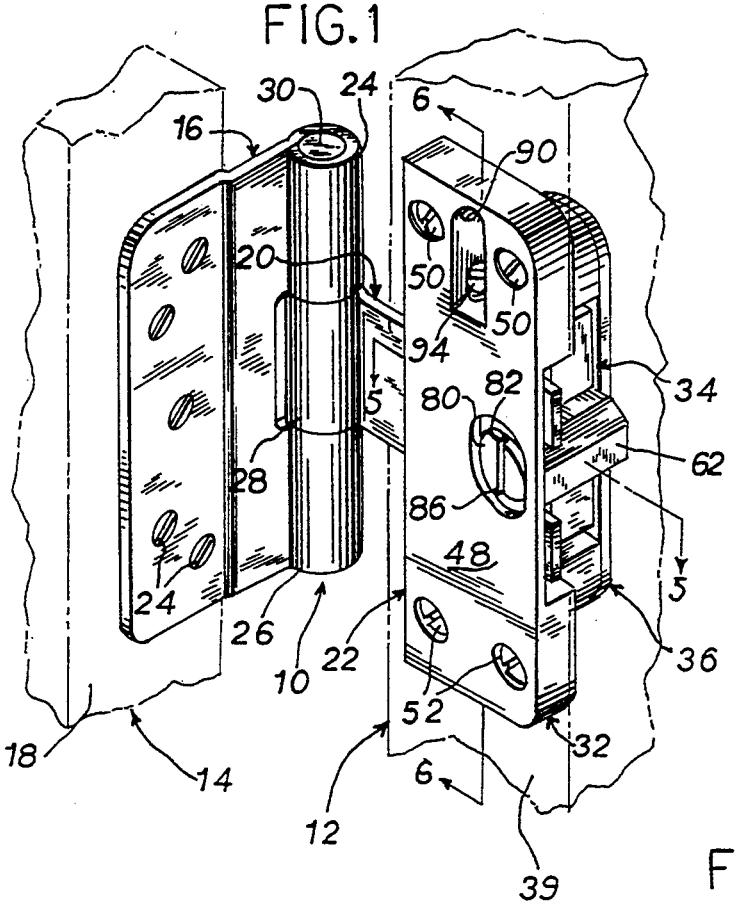
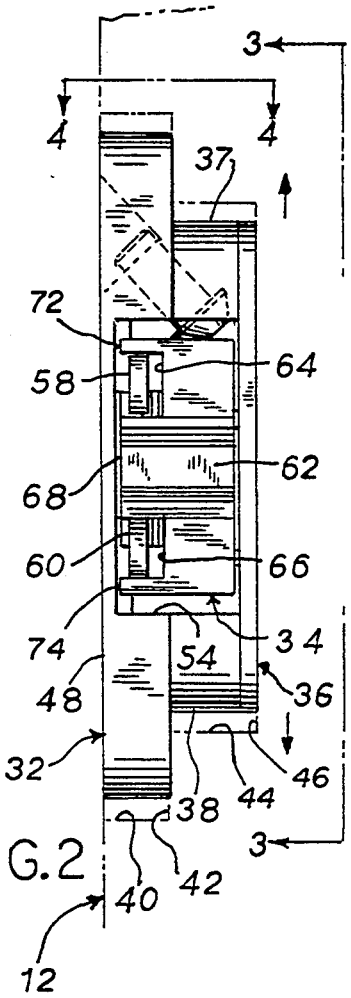
FIG. 2
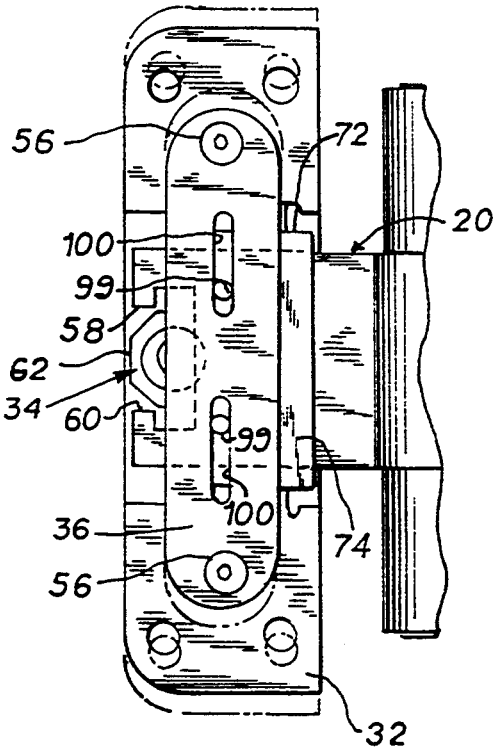
FIG. 3
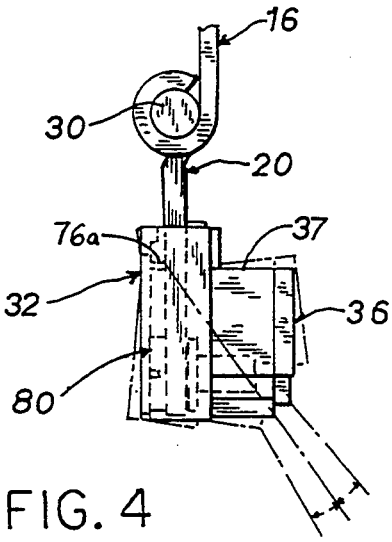
FIG. 4

FIG. 5
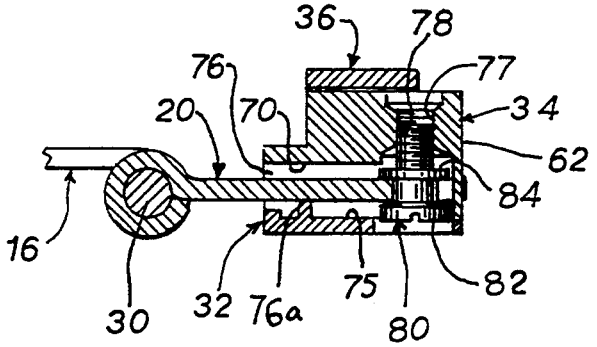
FIG. 6
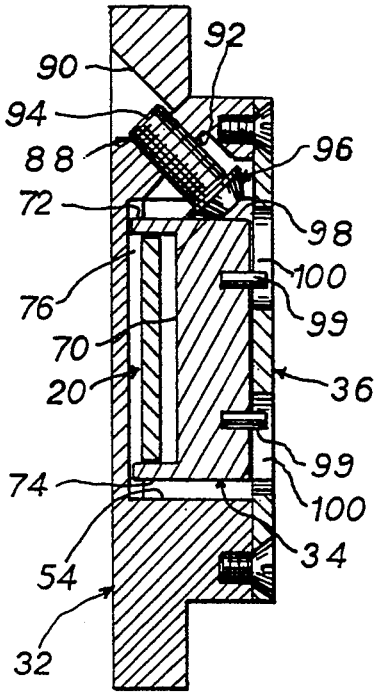
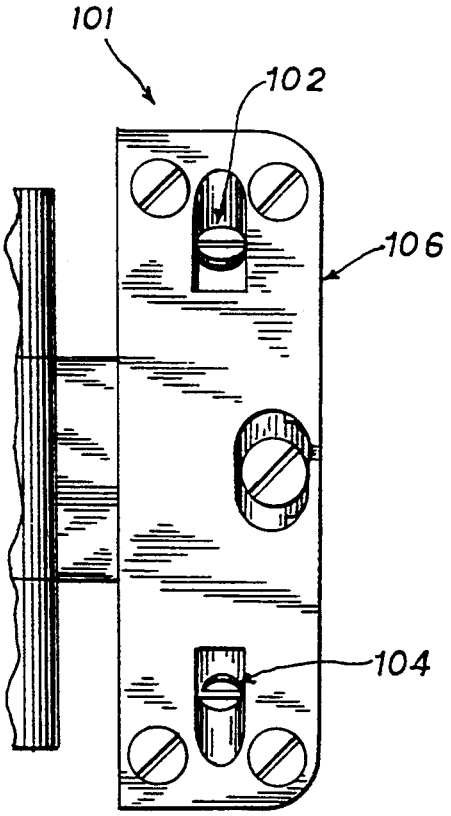
FIG. 7
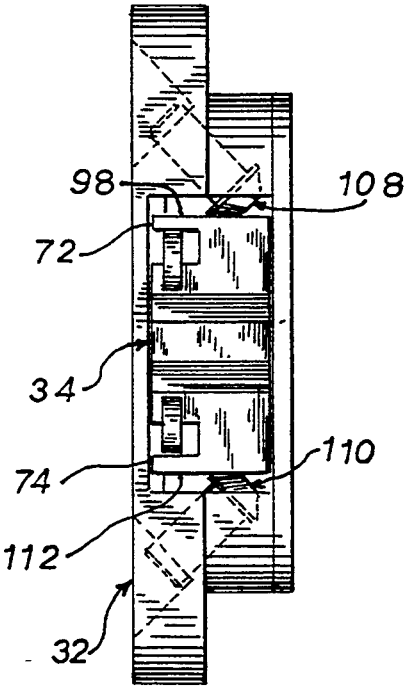
FIG. 8

ADJUSTABLE HINGE

BACKGROUND AND SUMMARY OF THE INVENTION

This invention pertains to an adjustable hinge for mounting a door to a frame, and more particularly to a hinge for providing adjustment of the door relative to the frame in both vertical and horizontal directions.

In mounting a door to a frame, it is often difficult to obtain precisely the desired position of the door relative to the frame. For this reason, it is common for door manufacturers to market pre-hung doors in which the door is mounted to the frame at the factory under controlled conditions so that precise positioning of the door can be obtained. The door and frame assembly is then shipped as a unit to the construction site for installation into an opening formed in a wall.

However, there are times when pre-hung doors cannot be employed and it is necessary to hang a door in an existing opening in which a frame has been constructed. In addition, not all doors for new construction are available in pre-hung form, making it necessary to construct a frame within an opening and to fit the door into the frame. In these instances, obtaining precise positioning of the door within the frame is a difficult and time consuming task even for the most skilled workman.

It is object of the present invention to provide an adjustable hinge adapted for connection to a conventional door frame for providing positioning of the door relative to the frame after the door has been mounted to the frame. It is a further object of the invention to provide an adjustable hinge in which the position of the door relative to the frame can be adjusted in both the vertical and horizontal directions. It is a further object of the invention to provide an adjustable hinge which is relatively simple in its construction and relatively easy to install.

In accordance with one aspect of the invention, an adjustable hinge broadly consists of a frame leaf for mounting to the door frame, a door leaf pivotably mounted to the frame leaf, and an adjustable mounting arrangement for mounting the door leaf to the door. The adjustable mounting arrangement includes a base member to which the door leaf is mounted and a cover member fixedly mounted to the door, with the base member and the cover member being interconnected to form a mounting assembly. The mounting assembly includes a vertically and horizontally adjustable mounting arrangement for mounting the door leaf to the mounting assembly, for providing vertical and horizontal adjustability in the vertical and horizontal position of the door relative to the frame.

In accordance with another aspect of the invention, the door includes a recess within which the mounting assembly formed by the cover member and the base member are received. In this manner, the mounting assembly does not interfere with the surfaces of the door and frame which face each other when the door is closed. The cover member is mounted within a first recess formed in the door, and includes a planar outer surface which is coplanar with the facing surface of the door when the mounting assembly is mounted to the door. A second recess extends inwardly from the first recess and the base member is mounted within the second recess.

In accordance with yet another aspect of the invention, horizontal adjustment of the adjustable mounting arrangement is provided by a threaded member interconnected with the base member, with the door leaf being mounted to and horizontally movable with the threaded member for adjusting the horizontal position of the door leaf relative to the door. The base member is fixedly mounted to the cover member against horizontal movement, and the base member and cover member cooperate to define a ribbed passage within which the door leaf is received. The threaded member includes structure for securing the door leaf thereto, whereby movement of the threaded member relative to the base member results in leveraged horizontal movement of the door leaf within the ribbed passage, to adjust the horizontal position of the door relative to the door leaf. The base member is received within a cavity defined by the cover member, and is fixedly mounted to the cover member against horizontal movement by means of a plate member secured to the cover member to capture the base member within the internal cavity defined by the cover member. The threaded member includes a head, and the structure for securing the door leaf to the threaded member consists of a shoulder provided on the threaded member spaced from the head, with the door leaf being received within the space between the head and the shoulder of the threaded member.

In accordance with yet another object of the invention, vertical adjustment of the adjustable mounting arrangement is accomplished by means of a vertical adjustment mechanism interposed between the cover member and the base member, with the door leaf being engaged with the base member. Adjustment in the vertical position of the base member relative to the cover member results in adjustment of the vertical position of the door relative to the door leaf, to adjust the vertical position of the door relative to the frame. The base member is mounted for vertical movement relative to the cover member, and a threaded adjustment screw is engaged with the cover member and with the base member for adjusting the vertical position of the base member relative to the cover member. The base member is located within an internal cavity defined by the cover member and is vertically movable within the internal cavity in response to turning of the threaded adjustment screw. The cover member defines a vertical opening providing access to the internal cavity within which the base member is received, and a plate member is positioned over the opening to secure the base member within the internal cavity and to fix the base member against horizontal movement therewithin. The cover member includes a recess and a threaded passage extending inwardly at an angle from the recess. The head of the vertical adjustment screw is disposed within the recess. Turning of the vertical adjustment screw results in vertical movement of the threaded member, for adjusting the vertical position of the base member relative to the cover member.

The above-summarized aspects of the invention are preferably all combined into an adjustable hinge which is easily installed, provides essentially the same outward appearance as a conventional hinge, and which provides the capability of adjusting the vertical or horizontal position of the door relative to the frame at any time after installation of the door.

Various other features, objects and advantages of the invention will be made apparent from the following description taken together with the drawings.

BRIEF DESCRIPTION OF THE DRAWINGS

The drawings illustrate the base mode presently contemplated of carrying out the invention.

In the drawings:

FIG. 1 is an isometric view of an adjustable hinge constructed according to the invention showing the door and frame in phantom;

FIG. 2 is a side elevation view showing the adjustable mounting assembly of the adjustable hinge of FIG. 1 for mounting the hinge to the door;

FIG. 3 is a partial rear elevation view, reference being made to line 3—3 of FIG. 2, showing the adjustable mounting assembly illustrated in FIG. 2;

FIG. 4 is a top plan view, reference being made to line 4—4 of FIG. 2, showing the adjustable mounting assembly;

FIG. 5 is a partial section view taken along line 5—5 of FIG. 1;

FIG. 6 is a section view taken along line 6—6 of FIG. 1;

FIG. 7 is a front elevation view of an alternate embodiment for the adjustable mounting assembly of the adjustable hinge of the invention; and FIG. 8 is a side elevation view of the adjustable mounting assembly of FIG. 7.

DETAILED DESCRIPTION OF THE INVENTION

FIG. 1 generally illustrates an adjustable hinge 10 for mounting a door, shown in phantom at 12, to a frame, shown in phantom at 14. Generally, hinge 10 includes a frame leaf 16 mounted to surface 18 of frame 14, a door leaf 20, and an adjustable mounting assembly 22 mounted to door 12 and interconnected with door leaf 20. Frame leaf 16 is mounted to surface 18 of frame 14 by a series of threaded screws 24 extending through openings formed in frame leaf 16 and into frame 14. Frame leaf 16 includes a pair of sleeves 24,26 at its outer end. Door leaf 20 likewise includes a sleeve 28 positioned between sleeves 24,26 defined by frame leaf 16. Sleeves 24–28 each define coaxial passages, within which a pin 30 is received for pivotably mounting door leaf 20 to frame leaf 16.

Referring to FIGS. 1 and 2, adjustable mounting assembly 22 consists of a cover 32, a base 34, and a plate 36. Plate 36 is mounted to upper and lower rearward extensions 37, 38 defined by cover 32.

Door 12 defines an edge surface 39 which is adapted to face surface 18 of frame 14 when door 12 is closed. Adjustable mounting assembly 22, defined by cover 32, base 34 and plate 36, is positioned within a recess formed in door 12 extending inwardly from its edge surface 39. Referring to FIG. 2, the recess formed in door 12 includes a first shallow recess defining a wall 40 and a shoulder 42, and a second deep recess extending inwardly from the shallow recess, defining a side wall 44 and an inner wall 46. Side wall 40 of the shallow recess is formed to define an opening having a shape corresponding to the contour defined by the forward portion of cover 32 and a depth substantially equal to the thickness thereof. In this manner, cover 32 is mounted within the shallow recess formed in door 12 such that the outer surface of cover member 32, shown at 48, is substantially flush with edge surface 39 of door 12. A pair of upper openings extend through cover 32 to receive threaded screws 50 (FIG. 1) and a pair of openings are formed in the lower portion of cover 32 for receiving a pair of threaded screws 52. Screws 50, 52 function to mount cover 32, and thereby adjustable mounting assembly 22, to door 12.

Rearward extensions 37, 38 of cover 32 and plate 36 are received within the deep recess formed in door 12. Sidewall 44 defined by the deep recess has a width substantially equal to the combined width of extensions 37, 38 and plate member 36.

The recesses defining sidewalls 40, 44, shoulder 42 and inner wall 46 are pre-formed in edge surface 39 of door 12 in a conventional manner, such as by routing or the like. After the recesses are formed, a cut-out is formed between the shallow recess and the inner surface of door 12 for accommodating door leaf 20.

Referring to FIG. 2, base 34 is positioned within an internal cavity 54 defined by cover 32 and plate 36. The width of internal cavity 54 is only slightly greater than that of base 34. Plate 36 is mounted to the rearwardly facing surfaces defined by rearward extensions 37, 38 of cover 32 by means of a pair of machine screws 56 (FIG. 3) extending through plate 36 and into threaded passages formed in cover 32, or by any other satisfactory attachment mechanism. Plate 36 functions to maintain base 34 within internal cavity 54 and to fix base 34 against horizontal movement relative to cover 32.

As shown in FIGS. 1–3, a channel-shaped opening is provided in the outer end of door leaf 20, defining a pair of ears 58,60 between which a boss 62 provided on base member 34 is received. Base 34 further includes channel-like upper and lower recessed areas 64, 66 (FIG. 2), respectively, through which the upper and lower portions of door leaf 20 extend. Recessed areas 64,66 extend inwardly from the front surface of base 34, shown at 68 (FIG. 2). With this arrangement, door leaf 20 is mounted for front-rear movement within recessed areas 64,66 of base member 34.

Referring to FIGS. 5 and 6, recessed areas 64, 66 of base 34 merge into a recess 70 which extends between upper and lower tabs 72,74, respectively. Recess 70 has a height only slightly greater than that of door leaf 20, so that door leaf 20 is positioned between and engages the lower surface of upper tab 72 and the upper surface of lower tab 74. With this arrangement, door leaf 20 is fixed against vertical movement relative to base 34.

Recess 70, in combination with a recess 75 formed in the rear of cover 32, forms a passage 76 through which door leaf 20 extends outwardly from pin 30. A rib **76*a* projects inwardly from cover 32 into passage 76 and bears against door leaf 20**.

Referring to FIG. 5, base 34 further includes an internally threaded passage 77 formed in boss 62 within which the threaded shank 78 of a horizontal adjustment screw 80 is engaged. Adjustment screw 80 further includes a head 82 and a circumferential shoulder 84 spaced from head 82. Door leaf 20 is received within the space between head 80 and shoulder 84, and includes a notched or cut-out portion partially encircling adjustment screw 80 between head 82 and shoulder 84. An opening 86 is formed in outer surface 48 of cover 32 for providing access to head 82 of adjustment screw 80.

With this arrangement, the position of base 34 relative to door leaf 20 can be adjusted by turning horizontal adjustment screw 80 into and out of threaded passage 77 in base 34 such that door leaf 20 is pivoted or leveraged on rib **76*a* which acts as a fulcrum. Since base 34 is fixed against horizontal movement relative to cover 32, and since cover 32 is fixed to door 12, such horizontal adjustment in the position of base 34 relative to door leaf 20 results in leveraged horizontal adjustment in the position of door 12 relative to door leaf 20 and to frame 14**.

As shown in FIG. 6, a vertical adjustment screw 88 is engaged within a threaded passage formed in cover 32 extending between an outer recess 90 and an inner recess 92. Vertical adjustment screw 88 includes a head 94 positioned within outer recess 90 and an inner beveled end portion 96 disposed within internal cavity 54 defined by cover 32. The beveled surface provided on inner beveled end portion 96 is angled so as to provide line contact between beveled end portion 96 and the upper flat surface of base 34, shown at 98.

Head 94 of vertical adjustment screw 88 is accessible through recess 90, which opens onto outer surface 48 of cover 32. Turning of vertical adjustment screw 88 results in movement of inner beveled end portion 96 in an up-down direction to control the vertical position of base 34 within internal cavity 54 defined by cover 32.

Referring to FIGS. 3 and 6, a pair of pins 99 are mounted to base 34, extending rearwardly from the rear surface of base 34. Pins 99 are received within vertically elongated slots 100 formed in plate 36. Pins 99 and slots 100 function to prevent side-to-side lateral movement of base 34 relative to plate 36 and cover 32, while slots 100 accommodate vertical movement of base 34 relative to plate 36 and cover 32.

In operation, an operator adjusts the horizontal position of door 12 relative to frame 18 by turning horizontal adjustment screw 80. As noted previously, this adjusts the horizontal position of door 12 relative to door leaf 20. Since door leaf 20 is fixed, at any one rotational position relative to frame 14 through frame leaf 16 and pin 30, the horizontal position of door 12 relative to frame 14 is thus adjusted. The vertical position of the door 12 relative to frame 14 is adjusted by turning vertical adjustment screw 88. When vertical adjustment screw 88 is turned so as to provide upward movement of its inner beveled end portion 96, cover 32 moves downwardly relative to base 34 under the weight of door 12. Since door leaf 20 is engaged with base 34 and fixed against vertical movement thereto, this results in downward movement of door 12 relative to door leaf 20, and thereby downward movement of door 12 relative to frame 18. Turning vertical adjustment screw 88 so as to provide downward movement of its inner beveled end portion 96 raises cover 32 relative to base 34, to thereby raise door 12 relative to frame 14. During turning of vertical adjustment screw 88, its inner beveled end portion 96 travels in a front-rear direction along top surface 98 of base 34. Recess 90 is provided with sufficient depth to ensure that head 94 of vertical adjustment screw 88 is at all times inwardly of the opening of recess 90 onto outer surface 48 of cover 32.

The range of leveraged horizontal movement of base 34 relative to door leaf 20 is illustrated in detail in FIG. 4.

FIGS. 1–6 illustrate a handed version of adjustable hinge 10. That is, hinge 10 as illustrated in FIGS. 1–6 can only be employed when door 12 is adapted to be opened in one direction. This necessitates the need for an opposite handed structure for hinge 10 when employed in connection with opening a door in the opposite direction.

FIGS. 7–8 illustrate a non-handed version of the adjustable hinge constructed according to the invention, shown at 100.

Adjustable hinge 101 incorporates a pair of vertical adjustment screws, shown at 102,104. Screws 102, 104 are constructed substantially identically to vertical adjustment screw 88 in the embodiment of FIGS. 1–6. Recesses identical to recess 90 are formed in cover 104, which in all other respects is substantially identical to cover 32 in the embodiment of FIGS. 1–6. As shown in FIG. 8, upper vertical adjustment screw 102 includes an inner beveled end portion 108 which bears against the top surface 98 of base 34. Lower vertical adjustment screw 104 includes an inner beveled end portion 110 which bears against the lower surface, shown at 112, of base 34. In this arrangement, door 12 is lowered simply by turning upper vertical adjustment screw 108 so as to provide vertical upward movement, and the weight of door 12 functions to maintain engagement of its inner beveled end portion 108 with upper surface 98 of base 34. If desired, lower vertical adjustment screw 110 can be turned to provide its upward movement to sandwich base 34 between adjustment screws 108,110. To raise door 12, lower vertical adjustment screw 110 is first turned to provide its downward movement, and upper vertical adjustment screw 108 is then turned to provide its downward movement to raise cover 32 relative to base 34.

When hinge 101 is employed in an opposite hand end installation, the position and functioning of upper vertical adjustment screw 108 and lower vertical adjustment 110 are reversed from the above description.

As can be appreciated, the adjustable hinge provided by the invention functions to conceal within the door the components of the hinge which provide adjustment in the vertical and horizontal position of the door relative to the frame. It is thus unnecessary to form any special openings or recesses in the frame, as such can be carried out relatively easily on the door. The hinge of the invention further provides a unique arrangement providing single horizontal and vertical adjustment screws for adjusting the horizontal and vertical position of the door relative to the frame. The hinge incorporates a unique, compact and efficiently arranged system of components for carrying out adjustment in the vertical and horizontal position of the door relative to the frame.

Various alternatives and embodiments are contemplated as being within the scope of the following claims particularly pointing out and distinctly claiming the subject matter regarded as the invention.

I claim:

1. An adjustable hinge for mounting a door to a frame, comprising:

a frame leaf for mounting the hinge to the frame;

a door leaf pivotably mounted to the frame leaf; and an adjustable mounting arrangement for mounting the door leaf to the door, comprising a base member to which the door leaf is mounted, a cover member fixedly mounted to the door, wherein the base member and the cover member form a mounting assembly, and a vertically and horizontally adjustable mounting means for mounting the door leaf to the mounting assembly for providing vertical and leveraged horizontal adjustability in the vertical and horizontal position of the door relative to the frame, the base member being fixed with respect to the cover member when the door is to be horizontally adjusted and the base member being movable with respect to the cover member when the door is to be vertically adjusted.

2. The adjustable hinge of claim 1, wherein the door includes a recess within which the mounting assembly formed by the cover member and the base member is received so as to prevent interference of the adjustable mounting arrangement with the door and with the frame.

3. The adjustable hinge of claim 2, wherein horizontal adjustment of the vertically and horizontally adjustable mounting arrangement is accomplished by means of a threaded member threadably interconnected with the base member, wherein the door leaf is mounted to and movable with the threaded member for adjusting the horizontal position of the door leaf relative to the door.

4. The adjustable hinge of claim 3, wherein vertical adjustment of the vertical and horizontal mounting arrangement is carried out by means of a vertical adjustment mechanism interposed between the cover member and the base member, wherein the door leaf is engaged with the base member, whereby adjustment in the vertical position of the base member relative to the cover member results in adjustment in the vertical position of the door relative to the door leaf to adjust the vertical position of the door relative to the frame.

5. The adjustable hinge of claim 4, wherein the base member is mounted for vertical movement relative to the cover member, and wherein the vertical adjustment mechanism comprises a threaded member provided with a head, said threaded member threadably engaged with the cover member and engaged with the base member for adjusting the vertical position of the base member relative to the cover member.

6. The adjustable hinge of claim 5, wherein the cover member includes a recess and a threaded passage extending inwardly at an angle from the recess, wherein the head of the threaded member is disposed within the recess, wherein turning of the threaded member results in vertical movement of the threaded member for adjusting the vertical position of the base member relative to the cover member.

7. An adjustable hinge for mounting a door to a frame, comprising:

a frame leaf for mounting the hinge to the frame;

a door leaf pivotably mounted to the frame leaf; and an adjustable mounting arrangement for mounting the door leaf to the door, comprising a base member to which the door leaf is mounted, a cover member fixedly mounted to the door, wherein the base member and the cover member form a mounting assembly, and a vertically and horizontally adjustable mounting means for mounting the door leaf to the mounting assembly for providing vertical and horizontal adjustability in the vertical and horizontal position of the door relative to the frame;

wherein the door includes a recess within which the mounting assembly formed by the cover member and the base member is received so as to prevent interference of the adjustable mounting arrangement with the door and with the frame;

wherein horizontal adjustment of the vertically and horizontally adjustable mounting means is accomplished by means of a threaded member threadably interconnected with the base member, wherein the door leaf is mounted to and movable with the threaded member for adjusting the horizontal position of the door leaf relative to the door;

wherein the base member is fixedly mounted to the cover member against movement in a horizontal direction, and wherein the base member and the cover member cooperate to define a passage within which the door leaf is received, wherein the threaded member includes structure for securing the door leaf thereto, whereby horizontal movement of the threaded member results in horizontal movement of the door leaf within the passage to adjust the horizontal position of the door relative to the door leaf.

8. An adjustable hinge for mounting a door to a frame, comprising:

a frame leaf for mounting the hinge to the frame;

a door leaf pivotably mounted to the frame leaf; and an adjustable horizontal mounting arrangement for mounting the door leaf to the door, comprising a base member to which the door leaf is mounted, a cover member fixedly mounted to the door, wherein the base member and the cover member form a mounting assembly, and a horizontally adjustable mounting means for mounting the door leaf to the mounting assembly for providing leveraged horizontal adjustability in the position of the door leaf relative to the mounting assembly, and thereby in the horizontal position of the door relative to the frame, the horizontally adjustable mounting means comprising a threaded member threadably connected with the base member, wherein the door leaf is mounted to and movable with the threaded member, for adjusting the horizontal position of the door leaf relative to the door.

9. The adjustable hinge of claim 8, wherein the door includes a recess within which the mounting assembly formed by the cover member and the base member are received to prevent interference of the cover member and the base member with the door and with the frame.

10. An adjustable hinge for mounting a door to a frame, comprising:

a frame leaf for mounting the hinge to the frame;

a door leaf pivotably mounted to the frame leaf; and an adjustable horizontal mounting arrangement for mounting the door leaf to the door comprising a base member to which the door leaf is mounted, a cover member fixedly mounted to the door, wherein the base member and the cover member are interconnected to form a mounting assembly, and a horizontally adjustable mounting means for mounting the door leaf to the mounting assembly for providing horizontal adjustability in the position of the door leaf relative to the mounting assembly, and thereby in the horizontal position of the door relative to the frame, the horizontally adjustable mounting means comprising a threaded member interconnected with the base member, wherein the door leaf is mounted to and movable with the threaded meter, for the door;

wherein the base member is fixedly mounted to the cover member against horizontal movement, and wherein the base member and the cover member cooperate to define a passage within which the door leaf is received, wherein the threaded member includes structure for securing the door leaf thereto, whereby movement of the threaded member results in horizontal movement of the door leaf within the passage to adjust the horizontal position of the door relative to the door leaf.

11. The adjustable hinge of claim 10, wherein the base member is received within a cavity defined by the cover member, and is fixedly mounted to the cover member against horizontal movement by means of a plate member secured to the cover member to capture the base member within the internal cavity defined by the cover member and to prevent horizontal movement of the base member relative to the cover member.

12. The adjustable hinge of claim 9, wherein the threaded member includes a head, and wherein the structure for securing the door leaf to the threaded member comprises a shoulder provided on the threaded member and spaced from the head, wherein the door leaf is received within the space between the head and the shoulder of the threaded member.

13. The adjustable hinge of claim 10, further comprising a vertically adjustable mounting arrangement for mounting the door leaf to the mounting assembly for providing adjustability door leaf relative to the mounting assembly, and thereby in the vertical position of the door relative to the frame.

14. The adjustable hinge of claim 13, wherein the vertically adjustable mounting arrangement comprises a vertical adjustment mechanism interposed between the cover member and the base member, wherein the door leaf is engaged with the base member, whereby adjustment in the vertical position of the base member relative to the cover member results in adjustment in the vertical position of the door relative to the door leaf to adjust the vertical position of the door relative to the frame.

15. The adjustable hinge of claim 14, wherein the base member is received within a cavity defined by the cover member, and is fixedly mounted to the cover member against horizontal movement by means of a plate member secured to the cover member to capture the base member within the internal cavity defined by the cover member and to prevent horizontal movement of the base member relative to the cover member, and further comprising a vertical slot and pin arrangement interposed between the base member and the plate member for accommodating vertical movement of the base member relative to the cover member and for fixing the base member against lateral horizontal movement relative to the cover member.

16. An adjustable hinge for mounting a door to a frame, comprising:

a frame leaf for mounting the hinge to the frame;

a door leaf pivotably mounted to the frame leaf; and a vertically adjustable mounting arrangement for mounting the door leaf to the door, comprising a base member to which the door leaf is mounted, a cover member fixedly mounted to the door, wherein the base member and the cover member are interconnected to form a mounting assembly, and a vertically adjustable mounting arrangement for mounting the door leaf to the mounting assembly for providing vertical adjustability in the vertical position of the door relative to the frame, the vertically adjustable mounting arrangement comprising a one-step vertical adjustment mechanism interposed between the cover member and the base member, wherein the door leaf is engaged with the base member and fixed against vertical movement thereto, whereby adjustment in the vertical position of the base member and door leaf fixed thereto relative to the cover member is transmitted directly by a single screw-driven element and results in independent adjustment in the vertical position of the door relative to the door leaf to adjust the vertical position of the door relative to the frame.

17. The adjustable hinge of claim 16, wherein the base member is mounted for vertical movement relative to the cover member, and wherein the vertical adjustment mechanism comprises a threaded member provided with a head, said threaded member threadably engaged with the cover member and engaged with the base member for adjusting the vertical position of the base member relative to the cover member.

18. The adjustable hinge of claim 17, wherein the cover member includes a recess and a threaded passage extending inwardly at an angle from the recess, wherein the head of the threaded member is disposed within the recess, and wherein turning of the threaded member results in vertical movement of the threaded member for adjusting the vertical position of the base member relative to the cover member.

19. The adjustable hinge of claim 17, wherein the base member is received within an internal cavity defined by the cover member and is vertically movable within the internal cavity in response to turning of the threaded member.

20. The adjustable hinge of claim 17, further comprising a horizontally adjustable mounting arrangement for mounting the door leaf to the mounting assembly for providing adjustability in the horizontal position of the door leaf relative to the mounting assembly, and thereby in the horizontal position of the door relative to the frame.

21. The adjustable hinge of claim 20, wherein the base member is fixedly mounted to the cover member against horizontal movement, and wherein the base member and the cover member cooperate to define a passage within which the door leaf is received, wherein horizontal adjustment of the horizontally adjustable mounting arrangement comprises a second threaded member threadably interconnected with the base member and engaged with the door leaf, wherein the door leaf is mounted to and movable with the second threaded member for adjusting the horizontal position of the door leaf relative to the door, wherein movement of the second threaded member results in horizontal movement of the door leaf within the passage to adjust the horizontal position of the door relative to the door leaf.

22. The adjustable hinge of claim 21, wherein the base member is received within a cavity defined by the cover member, and is fixedly mounted to the cover member against horizontal movement by means of a plate member secured to the cover member to capture the base member within the cavity defined by the cover member and to prevent horizontal movement of the base member relative to the cover member, and further comprising a slot and pin arrangement interposed between the base member and the plate member for accommodating vertical movement of the base member relative to the cover member and for fixing the base member against lateral horizontal movement of the base member relative to the cover member.

23. An adjustable hinge for mounting a door to a frame, comprising:

a frame leaf for mounting the hinge to the frame;

a door leaf pivotably mounted to the frame leaf; and a vertically adjustable mounting arrangement for mounting the door leaf to the door, comprising a base member to which the door leaf is mounted, a cover member fixedly mounted to the door, wherein the base member and the cover member are interconnected to form a mounting assembly, and a vertically adjustable mounting means for mounting the door leaf to the mounting assembly for providing vertical adjustability in the vertical position of the door relative to the frame, the vertically adjustable mounting means comprising a vertical adjustment mechanism interposed between the cover member and the base member, wherein the door leaf is engaged with the base member, whereby adjustment in the vertical position of the base member relative to the cover member results in adjustment in the vertical position of the door relative to the door leaf to adjust the vertical position of the door relative to the frame, wherein the base member is mounted for vertical movement relative to the cover member, and wherein the vertical adjustment mechanism comprises a threaded member threadably engaged with the cover member and engaged with the base member for adjusting the vertical position of the base member relative to the cover member, wherein the base member is received within an internal cavity defined by the cover member and is vertically movable within the internal cavity in response to turning of the threaded member;

wherein the cover member defines a vertical opening providing access to the internal cavity for positioning the base member within the internal cavity, and further comprising a plate member positioned over the opening and secured to the cover member to secure the base member within the internal cavity and to fix the base member against horizontal movement within the internal cavity.

24. An adjustable hinge for mounting a door to a frame, the door and the frame defining facing surfaces which lie in substantially parallel planes and which face each other when the door is closed, comprising:

a frame leaf for mounting the hinge to the frame;

a door leaf pivotably mounted to the frame leaf; and an adjustable mounting arrangement for mounting the door leaf to the door, the adjustable mounting arrangement including a first portion fixedly mounted to the door; a second portion mounted to the first portion to form a mounting assembly, wherein the door leaf is engaged with the second portion; and an adjustment means for providing vertical and leveraged horizontal adjustability in the vertical and horizontal position of the door relative to the frame;

wherein the door includes a recess within which substantially the entire extent of the adjustable mounting arrangement is received so as to prevent interference of the adjustable mounting arrangement with the facing surfaces of the door and the frame.

25. The adjustable hinge of claim 24, wherein the adjustable mounting arrangement first portion comprises a cover member fixedly mounted to the door and wherein the adjustable mounting arrangement second portion comprises a base member with which the door leaf is engaged.

26. The adjustable hinge of claim 25, wherein the base member is mounted for vertical movement to the cover member within an internal cavity defined by the cover member, and further comprising a vertical adjustment screw engaged with the cover member and with the base member for adjusting the vertical position of the base member relative to the cover member, and thereby the vertical position of the door leaf relative to the mounting assembly formed by the cover member and the base member, wherein the cover member defines a recess within which the head of the vertical adjustment screw is located.

27. The adjustable hinge of claim 25, wherein the cover member includes an outer planar surface substantially coplanar with the facing surface of the door.

28. The adjustable hinge of claim 27, wherein the cover member includes a series of passages opening onto the planar outer surface of the cover member, and wherein the cover member is mounted to the door by means of threaded mounting screws extending through the passages formed in the cover member and into the door.

29. An adjustable hinge for mounting a door to a frame, the door and the frame defining facing surfaces which lie in substantially parallel planes and which face each other when the door is closed, comprising:

a frame leaf for mounting the hinge to the frame;

a door leaf pivotably mounted to the frame leaf; and an adjustable mounting arrangement for mounting the door leaf to the door, the adjustable mounting arrangement including a first portion fixedly mounted to the door; a second portion mounted to the first portion to a form a mounting assembly, wherein the door leaf is engaged with the second portion; and an adjustment means for adjusting the vertical and horizontal position of the door relative to the frame;

wherein the door includes a recess within which substantially the entire extent of the adjustable mounting arrangement is received so as to prevent interference of the adjustable mounting arrangement with the facing surfaces of the door and the frame;

wherein the adjustable mounting arrangement first portion comprises a cover member fixedly mounted to the door and wherein the adjustable mounting arrangement second portion comprises a base member with which the door leaf is engaged;

wherein the base member is fixed against horizontal movement relative to the cover member, and further comprising a horizontal adjustment screw mounted within a threaded passage provided in the base member, wherein the door leaf is mounted to the horizontal adjustment screw so as to provide adjustment in the horizontal position of the door leaf relative to the mounting assembly formed by the base member and the cover member in response to turning of the horizontal adjustment screw, and wherein the cover member defines an opening providing access to the head of the horizontal adjustment screw.

* * * * *

UNITED STATES PATENT AND TRADEMARK OFFICE

CERTIFICATE OF CORRECTION

PATENT NO. : 5,339,493

DATED : August 23, 1994

INVENTOR(S) : Robert J. Macintyre

It is certified that error appears in the above-indentified patent and that said Letters Patent is hereby corrected as shown below:

CLAIM 10, Col. 8, Line 53, after "threaded member" insert -- threadably --; CLAIM 10, Col. 8, Line 55, delete "meter, for" and substitute therefor -- member, for adjusting the horizontal position of the door leaf relative to --; CLAIM 12, Col. 9, Line 6, delete "9" and substitute therefor -- 10 --; CLAIM 13, Col. 9, Line 16, after "adjustability" delete "door leaf relative to the mounting assembly, and thereby";

Signed and Sealed this

Twenty-second Day of November, 1994

*Attest:*

Bruce Lehman

BRUCE LEHMAN

*Attesting Officer*

*Commissioner of Patents and Trademarks*